US010736439B2

(12) United States Patent
Schreiber et al.

(10) Patent No.: US 10,736,439 B2
(45) Date of Patent: Aug. 11, 2020

(54) INSULATING GLASS ELEMENT FOR A REFRIGERATION CABINET

(71) Applicant: SAINT-GOBAIN GLASS FRANCE, Courbevoie (FR)

(72) Inventors: Walter Schreiber, Aachen (DE); Hans-Werner Kuster, Aachen (DE); Edouard Jonville, Puteaux (FR)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 225 days.

(21) Appl. No.: 15/780,040

(22) PCT Filed: Dec. 20, 2016

(86) PCT No.: PCT/EP2016/082042
§ 371 (c)(1),
(2) Date: May 30, 2018

(87) PCT Pub. No.: WO2017/108870
PCT Pub. Date: Jun. 29, 2017

(65) Prior Publication Data

US 2018/0344053 A1 Dec. 6, 2018

(30) Foreign Application Priority Data

Dec. 21, 2015 (EP) ..... 15201483

(51) Int. Cl.
*A47F 3/04* (2006.01)
*E06B 3/673* (2006.01)
*E06B 3/663* (2006.01)

(52) U.S. Cl.
CPC ..... *A47F 3/0434* (2013.01); *E06B 3/66361* (2013.01); *E06B 3/66371* (2013.01); *E06B 3/67356* (2013.01); *E06B 2003/6638* (2013.01)

(58) Field of Classification Search
CPC .... A47F 3/005; A47F 3/0434; E06B 3/66304; E06B 3/66309; E06B 3/66314;
(Continued)

(56) References Cited

U.S. PATENT DOCUMENTS 1,845,133 A * 2/1932 Davis, Jr. ..... B32B 17/08 428/81
2,077,305 A * 4/1937 Batchell ..... E06B 3/66333 428/34

(Continued)

FOREIGN PATENT DOCUMENTS

CA 2878788 A1 * 1/2014 ..... E06B 3/66333
CH 687937 A5 3/1997

(Continued)

OTHER PUBLICATIONS

International Search Report for International Application No. PCT/EP2016/074546 filed Oct. 13, 2016 on behalf Saint-Gobain Glass France, dated Nov. 4, 2016. 5 pages. (German original + English translation).

(Continued)

*Primary Examiner* — Robert Canfield
(74) *Attorney, Agent, or Firm* — Pillsbury Winthrop Shaw Pittman LLP

(57) ABSTRACT

An insulating glass element suitable for a refrigeration cabinet. The insulating glass element includes a first pane and a second pane spaced at a distance from the first pane. The first pane has two opposite parallel horizontal edges and two opposite parallel vertical edges. The second pane has two opposite parallel horizontal edges and two opposite parallel vertical edges. According to one aspect, two horizontal spacers are arranged between the first pane and the second pane. According to another aspect, two vertically arranged flat profiles are secured to the vertical edges of the first pane and to the vertical edges of the second pane.

(Continued)

Figure 1:
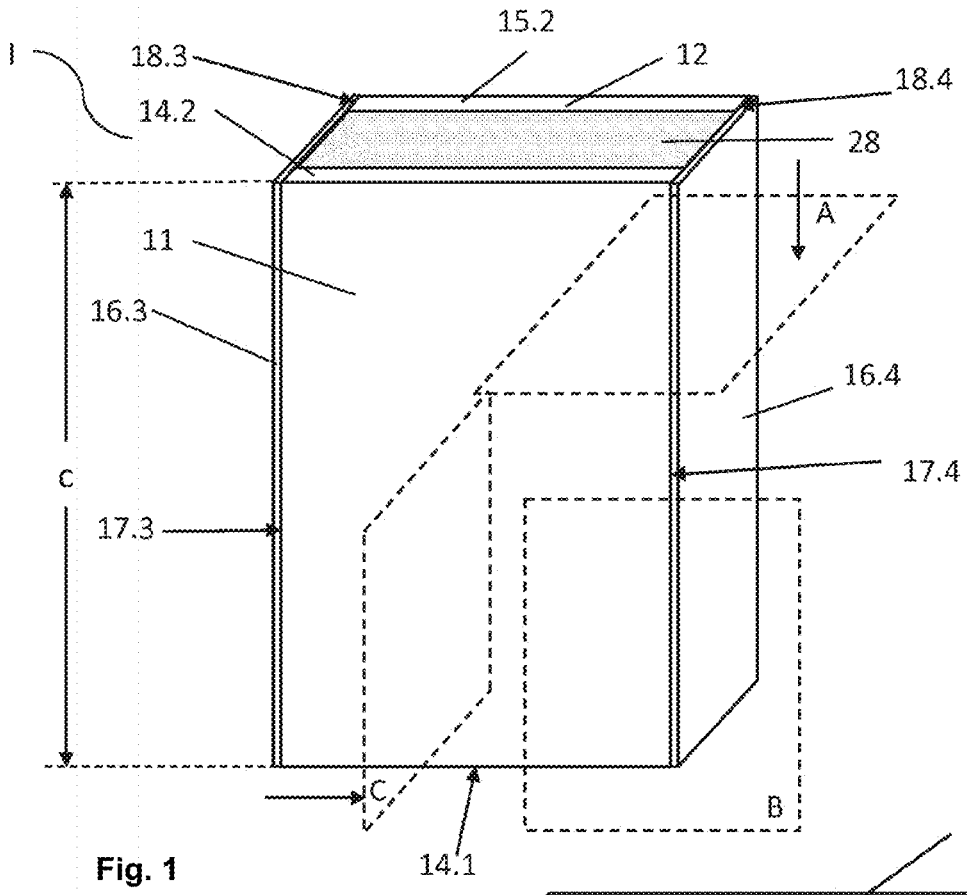

According to yet another aspect, the spacers and the flat profiles enclose an inner interpane space between the first pane and the second pane, and one of the two flat profiles is transparent.

17 Claims, 4 Drawing Sheets

(58) Field of Classification Search
CPC ..... E06B 3/67356; E06B 3/6715; E06B 2003/66338; B32B 17/10302
USPC ..... 52/172, 204.593, 786.13, 802.1; 49/501; 428/34; 312/116; 62/246
See application file for complete search history.

(56) References Cited

U.S. PATENT DOCUMENTS

| | | | | | |
|---|---|---|---|---|---|
| 2,235,680 | A * | 3/1941 | Haven | B23K 1/19 | 428/34 |
| 2,235,681 | A * | 3/1941 | Haven | E06B 3/66342 | 428/34 |
| 2,303,125 | A * | 11/1942 | Knight | E06B 3/6715 | 428/83 |
| 2,618,819 | A * | 11/1952 | Goodwillie | E06B 3/6621 | 428/34 |
| 2,838,809 | A * | 6/1958 | Zeolla | E06B 3/677 | 52/172 |
| 3,473,988 | A * | 10/1969 | Drouet | B29C 63/0039 | 156/107 |
| 3,918,202 | A | 11/1975 | Smith | | |
| 4,332,663 | A | 6/1982 | Berneke | | |
| 4,453,855 | A | 6/1984 | Richter et al. | | |
| 4,551,364 | A | 11/1985 | Davies | | |
| 4,604,840 | A | 8/1986 | Mondon | | |
| 4,658,553 | A | 4/1987 | Shinagawa | | |
| 4,817,354 | A | 4/1989 | Bayer | | |
| 4,887,402 | A | 12/1989 | Da Col | | |
| 5,122,403 | A * | 6/1992 | Roginski | B32B 17/10036 | 428/38 |
| 5,154,531 | A | 10/1992 | Peterson | | |
| 6,209,269 | B1 | 4/2001 | Valderrama | | |
| 6,247,948 | B1 | 6/2001 | Davis et al. | | |
| 6,868,648 | B2 | 3/2005 | Glover et al. | | |
| 8,240,940 | B2 | 8/2012 | Strohheker | | |
| 2005/0003116 | A1 | 1/2005 | Demars et al. | | |
| 2006/0105121 | A1* | 5/2006 | Cruz | F41H 5/0407 | 428/34 |
| 2007/0218224 | A1 | 9/2007 | Farbstein | | |
| 2009/0129857 | A1 | 5/2009 | Strohheker | | |
| 2009/0211188 | A1 | 8/2009 | Defoort et al. | | |
| 2011/0296771 | A1* | 12/2011 | Miller | E06B 3/56 | 52/171.3 |
| 2013/0040079 | A1* | 2/2013 | Caliaro | E06B 3/66309 | 428/34 |
| 2014/0010976 | A1* | 1/2014 | Gerardin | B32B 17/10761 | 428/34 |
| 2014/0205774 | A1* | 7/2014 | Caliaro | E06B 3/66357 | 428/34 |
| 2014/0265758 | A1 | 9/2014 | Reichert | | |
| 2014/0311065 | A1 | 10/2014 | Schreiber | | |
| 2015/0075902 | A1* | 3/2015 | Schreiber | E06B 3/6612 | 181/294 |
| 2015/0140258 | A1* | 5/2015 | Bouesnard | E06B 3/6612 | 428/69 |
| 2015/0151511 | A1 | 6/2015 | Weiss | | |
| 2015/0245720 | A1* | 9/2015 | Isfort | A47F 3/04 | 312/116 |
| 2016/0120336 | A1 | 5/2016 | Schneider et al. | | |
| 2016/0201381 | A1* | 7/2016 | Kuster | E06B 3/66304 | 52/172 |
| 2016/0222717 | A1* | 8/2016 | Bienick | E06B 3/66309 | |
| 2018/0195339 | A1 | 7/2018 | Kuster et al. | | |
| 2019/0211614 | A1* | 7/2019 | Culot | C08K 5/57 | |
| 2020/0071988 | A1* | 3/2020 | Gubbels | C08K 5/5419 | |

FOREIGN PATENT DOCUMENTS

| | | | | |
|---|---|---|---|---|
| CN | 85107089 | A | 4/1987 | |
| CN | 102032747 | A | 4/2011 | |
| CN | 102216074 | A | 10/2011 | |
| CN | 104011313 | A | 8/2014 | |
| CN | 104508411 | A | 4/2015 | |
| DE | 3403133 | A1 | 8/1985 | |
| DE | 3520973 | A * | 12/1986 | |
| DE | 19828565 | A1 * | 1/2000 | A47F 3/0434 |
| DE | 102005002285 | A1 | 7/2006 | |
| DE | 60224695 | T2 | 1/2009 | |
| DE | 102012106200 | A1 | 1/2014 | |
| DE | 202012013218 | U1 * | 6/2015 | E06B 3/66333 |
| DE | 112014002800 | T5 | 3/2016 | |
| EP | 0086345 | | 8/1983 | |
| EP | 2007961 | A1 | 12/2008 | |
| EP | 2194222 | A2 * | 6/2010 | E06B 3/025 |
| EP | 2930296 | A1 | 10/2015 | |
| FR | 2483845 | A1 * | 12/1981 | B32B 17/10761 |
| JP | 2008-013416 | A | 1/2008 | |
| JP | 2015-522149 | A | 8/2015 | |
| KR | 10-2005-0055002 | A | 6/2005 | |
| KR | 10-2006-0128613 | A | 12/2006 | |
| KR | 10-2014-0100573 | A | 8/2014 | |
| WO | 01/65047 | A1 | 9/2001 | |
| WO | 2006/123935 | A1 | 11/2006 | |
| WO | 2007/118611 | A1 | 10/2007 | |
| WO | 2013/104507 | A1 | 7/2013 | |
| WO | 2014/009244 | A1 | 1/2014 | |
| WO | 2014/131094 | A1 | 9/2014 | |
| WO | 2014/152730 | A1 | 9/2014 | |
| WO | 2014/198549 | A1 | 12/2014 | |
| WO | WO-2017108870 | A1 * | 6/2017 | E06B 3/66361 |

OTHER PUBLICATIONS

Written Opinion for International Application No. PCT/EP2016/074546 filed Oct. 13, 2016 on behalf of Saint-Gobain Glass France, dated Nov. 4, 2016. 11 pages. (German original + English translation).

International Search Report for International Application No. PCT/EP2017/056477 filed Mar. 20, 2017 on behalf of Saint-Gobain Glass France, dated Jun. 19, 2017. 5 pages. (German original + English translation).

International Search Report for International Application No. PCT/EP2016/082042 filed Dec. 20, 2016 on behalf of Saint-Gobain Glass France, dated Apr. 26, 2017. 5 pages. (German original + English translation).

Non-Final Office Action for U.S. Appl. No. 15/740,344, filed Mar. 30, 2018, on behalf of Saint-Gobain Glass France, dated Oct. 2, 2018. 22 pgs.

Written Opinion for International Application No. PCT/EP2016/062042 filed Dec. 20, 2016 on behalf of Saint-Gobain Glass France, dated Apr. 26, 2017. 9 pages. (English Translation + German Original).

Written Opinion for International Application No. PCT/EP2017/056477 filed Mar. 20, 2017 on behalf of Saint-Gobain Glass France, dated Jun. 19, 2017. 14 pages. (English Translation + German Original).

* cited by examiner

INSULATING GLASS ELEMENT FOR A REFRIGERATION CABINET

CROSS REFERENCE TO RELATED APPLICATIONS

The present application is the U.S. national stage of International Patent Application PCT/EP2016/082042 filed internationally on Dec. 20, 2016, which, in turn, claims priority to European Patent Application No. 15201483.3 filed on Dec. 21, 2015.

The invention relates to an insulating glass element for a refrigeration cabinet, a door for a refrigeration cabinet, a method for producing such an insulating glass element, and use thereof.

Refrigerated display cases or refrigerators with transparent doors are widely used to display and present refrigerated goods for customers. The goods are kept in the refrigerated display case at temperatures below 10° C. and thus protected against rapid spoiling. In order to keep the thermal loss as low as possible, insulating glass elements are frequently used as doors. Transparent doors enable viewing of goods without having to open the refrigerator or display case. Each opening of the doors results in an increase of the temperature in the refrigerated display case and thus exposes the goods to the risk of warming up. Consequently, it is desirable to present the goods in such a manner that the number of opening operations is minimized. To that end, it is important that the view through the closed doors be restricted as little as possible. In prior art insulating glass elements, the view is impeded at least in the edge region by elements of the nontransparent peripheral doorframe. In prior art insulating glass elements, the doorframe obscures the likewise nontransparent peripheral edge seal. The edge seal of an insulating glass element usually comprises at least a peripheral spacer, a hygroscopic desiccant as well as a primary sealant for securing the spacer between the panes, and a secondary sealant, which stabilizes and further seals the edge seal. These components are usually not transparent, in other words, in the region of the peripheral edge seal, the view is restricted.

Various approaches are known for solving this problem. Known from DE 10 2012 106 200 A1 is a refrigerator that has two insulating glass elements as doors, which include a transparent spacer element on at least one vertical side and have no frame element on this side. The spacer element is implemented as a T-shaped cross-sectional profile, which simultaneously serves a supporting and sealing function. The spacer element is implemented as a one-piece, solid profile produced by extrusion.

Another approach is described in WO2014/198549 A1. Here, transparent spacer elements that are arranged between the panes at least on one vertical side are also used. The transparent spacer elements are fixed between the panes with transparent sealants.

The object of the present invention is to provide an improved insulating glass element for a refrigeration cabinet that has the largest possible through-vision region and, simultaneously, has high stability, to provide a door for a refrigeration cabinet, and, also, to provide a simplified method for producing an insulating glass element.

The object of the present invention is accomplished by an insulating glass element in accordance with the present disclosure. Preferred embodiments are also disclosed.

The insulating glass element according to the invention for a refrigeration cabinet comprises at least one first pane and a second pane spaced at a distance therefrom. The first pane has two opposite parallel horizontal edges and two opposite parallel vertical edges. The second pane likewise has two opposite parallel horizontal edges and two opposite parallel vertical edges. At least two horizontally arranged spacers are installed between the first pane and the second pane. The spacers define the distance between the first pane and the second pane and are part of the edge seal of the insulating glass element. Two vertically arranged flat profiles are secured on the vertical edges of the first pane and on the vertical edges of the second pane. A first flat profile is secured on one vertical edge of the first pane and on one vertical edge of the second pane. The second flat profile is secured on the opposite parallel edges of the first and second panes. For example, the two flat profiles do not extend into a region between the two panes, in other words, the two flat profiles are not spacers arranged between the two panes. The flat profiles increase the mechanical stability of the insulating glass element and hold the two panes at a distance. The spacers and the flat profiles are arranged such that they enclose an inner interpane space between the first pane and the second pane. Preferably, the inner interpane space is directly or indirectly delimited by the two spacers and the two flat profiles, in other words, the two spacers and the two flat profiles are a direct boundary (direct border) of the inner interpane space. In particular, no transparent spacers are arranged between the panes at the vertical edge regions of the panes. Preferably, the spacers are arranged in the edge region of the panes such that the inner interpane space is as large as possible. At least one of the two flat profiles is transparent. This has the advantage that no barrier to vision is present along at least one vertical edge such that the through-vision area is maximized.

Thus, the invention provides an insulating glass element that has no vision-impeding edge seal in the region of the vertical edges. The flat profiles applied externally on the vertical edges enable a free view all the way to the pane edge. Since at least one of the flat profiles is transparent, unrestricted vision through the pane is possible at least on one vertical edge. The flat profiles contribute to increased stability of the insulating glass element such that, surprisingly, use of the door without any additional stabilizing frame element in the region of the vertical edge is possible.

The term "edges of the panes" refers to the glass edges that correspond substantially to the cut edges of the panes. In the simplest case, the edge forms a 90° angle with the surface of the pane. The edges are preferably polished or ground. Compared to broken edges, a more secure and simple attachment is possible here. At least the vertical edges of the first pane and the second pane are arranged flush, i.e., they are situated at the same level such that the flat profile can be stably secured on the two edges.

The terms "horizontal" and "vertical" refer to the orientation of the edges relative to one another. The two horizontal edges of a pane denote the opposite edges. The horizontal edges enclose an angle of substantially 90° with the vertical edges. The two vertical edges are positioned opposite one another. With installation of an insulating glass element as a door a display case or a refrigerated display case, the "horizontal edges" refer to the upper and lower edge. The vertical edges are, in this case, the right and left edge. With installation of the insulating glass element in, for example, a freezer cabinet in a horizontal orientation, the vertical edges, from the observer's standpoint, are also the right and the left edge and the horizontal edges, the rear and front edge.

In the context of the invention, "transparent" means that the material can be seen through. An observer can recognize items arranged behind the layer of material. The material is, accordingly, light permeable and preferably has light transmittance in the visible spectrum of at least 70%, particularly preferably of at least 80%. In addition, the material has as little light scattering (haze) as possible, in other words, the haze value is less than 40%, preferably less than 20%.

The flat profiles are designed such that they bridge the entire distance between the first pane and the second pane and extend beyond the vertical edges of the panes. The minimum width of the flat profiles is thus composed of the distance a between the first pane and the second pane, as well as the edge width b of the panes, which substantially matches the thicknesses of the panes. With this embodiment, the optically best results are obtained. Alternatively, the flat profiles can also be wider than the minimum width and surround the edges of the flat profiles. The length c of a flat profile is governed by the dimensions of the panes. The flat profile is at least as long as the vertical edges of the panes. The flat profile can be somewhat longer and arranged embracingly, by means of which the stability and the leak resistance of the entire assembly is improved. Since an edge seal that is not transparent is arranged along the horizontal edges, in this case an overlapping flat profile results in no optical disadvantage for the overall appearance.

Suitable nontransparent flat profiles are described in DE 602 24 695 T2. Here, among other things, flat profiles made of metal or plastic films with a metallic coating are disclosed. The metallic coating on plastic films is applied to obtain adequate sealing and to prevent penetration of moisture or loss of a gas filling. The flat profiles disclosed in DE 602 24 695 T2 are, however, not suitable as transparent flat profiles.

In a preferred embodiment, the at least one transparent flat profile includes at least one polymeric base film and a ceramic additional layer. Transparent polymeric base films are available economically. The ceramic additional layer can be applied as a transparent layer and contributes to the necessary gas diffusion resistance and moisture diffusion resistance of the flat profile. Thus, the structure comprising a polymeric base film and a ceramic additional layer enables production of a transparent flat profile.

In another preferred embodiment, the at least one transparent flat profile includes at least one polymeric base film and at least one transparent metallic additional layer. Transparent metallic additional layers improve the gas diffusion resistance and the moisture diffusion resistance of the flat profile.

In another preferred embodiment, the at least one transparent flat profile includes at least one polymeric base film, at least one ceramic additional layer, and at least one polymeric additional layer in this order. In this case, the ceramic additional layer is protected by a polymeric additional layer such that the leak resistance is retained even under mechanical stress. The polymeric additional layer can be made of the same materials as the polymeric base film. In another preferred embodiment, the flat profile includes, for further improvement of leak resistance, other polymeric additional layers and ceramic additional players, which are preferably arranged alternatingly. The alternating arrangement advantageously provides for a particularly long-lasting improvement of leak resistance since defects in one of the layers are compensated by the other layers. The adhesion of a plurality of thin layers one atop another is easier to realize than the adhesion of a few thick layers.

Preferably, the at least one transparent flat profile includes at least one polymeric additional layer and at least two ceramic additional layers and/or metallic additional layers, which are arranged alternatingly with the at least one polymeric additional layer. At least two ceramic and/or metallic additional layers ensure that defects in one of the two layers are compensated by the other. At least one polymeric additional layer is necessary for an alternating arrangement.

The polymeric base film preferably contains polyethylene (PE), polycarbonates (PC), polyesters, polyurethanes, polymethyl methacrylates, polyacrylates, polyamides, polyethylene terephthalate (PET), ethylene vinyl alcohol (EVOH), PET/PC, and/or copolymers thereof. These materials can be readily processed and coated or bonded with a ceramic or metallic additional layer. This choice of materials is also suitable for the polymeric additional layers.

The polymeric base film is preferably implemented as a single-layer film. This is advantageously economical. In an alternative preferred embodiment, the polymeric base film is implemented as a multilayer film. In this case, a plurality of layers made of materials listed above are bonded to one another. This is advantageous because the material properties can be perfectly coordinated with the sealants or adhesives used.

The ceramic additional layers preferably include silicon oxides ($SiO_x$) and/or silicon nitrides. The ceramic additional layers preferably have a thickness of 20 nm to 200 nm. Layers of these thicknesses improve the gas diffusion resistance and moisture diffusion resistance while retaining the desired optical properties.

The ceramic additional layers are preferably deposited on the polymeric base film in a vacuum thin-film method known to the person skilled in the art. This technique enables the selective deposition of defined ceramic additional layers without the use of additional adhesive layers.

Other polymeric additional layers are preferably bonded to the other layers of the flat profile via adhesion-promoting adhesive layers. Considered, for example, as adhesion-promoting adhesive layers are polyurethane-based transparent adhesive layers.

The polymeric additional layers preferably have a layer thickness of 5 μm to 80 μm.

The transparent metallic additional layer preferably contains aluminum, silver, magnesium, indium, tin, copper, gold, chromium, and/or alloys or oxides thereof. Particularly preferably, the transparent metallic additional layer contains indium tin oxide (ITO), aluminum oxide ($Al_2O_3$), and/or magnesium oxide. The metallic additional layer is preferably applied in a vacuum thin-film method and has a thickness of 20 nm to 100 nm, particularly preferably 50 nm to 80 nm.

The polymeric base film preferably has a thickness of 0.2 mm to 5 mm, particularly preferably 0.3 mm to 1 mm. With these thicknesses, adequate stability is obtained and, at the same time, the optical appearance of the insulating glass element is not degraded by a thicker flat profile.

Preferably, the MVTR (moisture vapor transmission rate) of the flat profiles is 0.05 g/($m^2$ d) and 0.001 g/($m^2$ d) [grams/square meter/day]. The MVTR is a measurement value that indicates the permeability of water vapor through the flat profile. It describes the amount of water in grams that diffuses through a square meter of material in 24 hours. With these values, particularly good long-term stability of the insulating glass element is obtained, in particular with use in refrigerated display cases.

In a preferred embodiment of the insulating glass element according to the invention, the flat profiles are secured to the interior side on the edges of the two panes via a transparent adhesive. The transparent adhesive is preferably moisture proof in order to enable optimal sealing of the inner interpane space. Particularly preferably, the transparent adhesive is an acrylate-, silicone-, or polyurethane-based adhesive. The securing via these adhesives is particularly long-lasting and stable and seals the inner interpane space reliably for a long time. Each flat profile has an inner side and an outer side. The inner side faces the inner interpane space; whereas, the outer side faces the external surroundings.

In a preferred embodiment of the insulating glass element according to the invention, the flat profiles have a sealing layer facing the inner side. A sealing layer enables the sealing of the flat profile on the edges of the panes without application of an additional adhesive being necessary. Preferably, the sealing layer includes or is made of a heat-sealable polymer. A heat-sealable polymer can readily be secured by being brought into contact with the surface of the edges and being pressed on at an elevated temperature. Particularly preferably, the sealing layer includes a low-density polyethylene (LDPE). With LDPEs, the gas and moisture diffusion resistance of the insulating glass element is further improved. A particularly leakproof connection between the edges and the flat profile is obtained.

In another preferred embodiment of the insulating glass element, the spacers are secured between the first pane and the second pane via a primary sealant. The primary sealant serves, on the one hand, for securing the spacer on the panes and, on the other, for sealing the edge seal, to prevent penetration of moisture into the inner interpane space and gas loss out of the inner interpane space. The spacer is preferably arranged such that an outer interpane space is created between the first pane and the second pane, delimited by the side of the spacer facing the external surroundings. Accordingly, the panes protrude somewhat beyond the spacer such that the outer interpane space is created. The outer interpane space is filled with a secondary sealant. The secondary sealant serves for mechanical stabilization of the insulating glass element, in that it partially absorbs the forces acting on the edge seal. In addition, if further seals the edge seal.

Preferably, the secondary sealant contains polymers or silane-modified polymers, particularly preferably organic polysulfides, silicones, room-temperature vulcanizing (RTV) silicone rubber, peroxide-vulcanizing silicone rubber, and/or addition-vulcanizing silicone rubber, polyurethanes, and/or butyl rubber. These sealants have a particularly good stabilizing effect.

The primary sealant preferably contains a polyisobutylene. The polyisobutylene can be a cross-linking or a non-cross-linking polyisobutylene.

In a preferred embodiment of the insulating glass element according to the invention, at least one of the spacers contains a desiccant. The desiccant can be introduced into the spacer or applied on the spacer. The desiccant binds moisture that is present in the inner interpane space and thus prevents fogging of the insulating glass element from the inside. Installation of the desiccant in at least one of the spacers that are mounted along the horizontal edges does not result in optical impairment of the insulating glass element since the nontransparent desiccant is situated in the edge region which is nontransparent anyway. The flat profiles need not be provided with desiccant since installation in at least one of the spacers is sufficient to prevent fogging of the panes. The desiccant preferably contains silica gels, molecular sieves, $CaCl_2$, $Na_2SO_4$, activated carbon, silicates, bentonites, zeolites, and/or mixtures thereof.

In a preferred embodiment of the insulating glass element, the spacers comprise in each case a hollow profile with a first side wall, a second side wall arranged parallel thereto, a glazing interior wall, an outer wall, and a hollow space. The hollow space is enclosed by the side walls, the glazing interior wall and the outer wall. The glazing interior wall is arranged perpendicular to the side walls and connects the first side wall to the second side wall. The side walls are the walls of the hollow profile, on which the outer panes of the insulating glass element are mounted. The first side wall and the second side wall run parallel to one another. The glazing interior wall is the wall of the hollow profile that faces the inner interpane space in the finished insulating glass element. The outer wall is arranged substantially parallel to the glazing interior wall and connects the first side wall to the second side wall. The outer wall faces the outer interpane space in the finished insulating glass element. The hollow space of the spacer according to the invention results in a weight reduction compared to a solidly formed spacer and is at least partially filled with a desiccant.

In a preferred embodiment of the insulating glass element according to the invention, the two individual spacers are, in each case, closed at both ends with a stopper. Each stopper includes a contact surface for connecting to a vertical flat profile. The contact surface runs parallel to the vertical flat profile. The stopper prevents a trickling out of the desiccant. In addition, the stability of the insulating glass element is increased since the flat profiles can be bonded not only to the edges, but also to the contact surface of the stopper. The stoppers are preferably made of a polymer, since polymers have advantageously low thermal conductivity. The same materials as for the hollow profile of the spacer are suitable. Particularly preferably, the stopper is made of a polyamide that preferably has a glass fiber content of up to 20%. Preferably, the contact surface of the stopper ends flush with the outside dimensions of the hollow profile. This embodiment saves material and can be easily installed using automation compared to an embodiment with protruding contact surfaces. Alternatively, the contact surface protrudes beyond the hollow profile in the direction of the outer interpane space. Preferably, the edge of the contact surface facing the external surroundings is then arranged flush with the edges of the panes. This embodiment is surprisingly stable. In addition, possible material incompatibilities or adhesion problems between a secondary sealant and the flat profile are avoided since the contact surface delimits the outer interpane space in this embodiment.

The outer wall of the hollow profile is the wall opposite the glazing interior wall, which faces away from the inner interpane space in the direction of the outer interpane space. The outer wall preferably runs perpendicular to the side walls. However, the sections of the outer wall nearest the side walls can, alternatively, be inclined at an angle of preferably 30° to 60° relative to the outer wall in the direction of the side walls. This angled geometry improves the stability of the hollow profile and enables better bonding of the hollow profile with a barrier film. A planar outer wall, which is perpendicular to the side walls (parallel to the glazing interior wall) in its entire course has, on the other hand, the advantage that the sealing surface between spacers and sidewalls is maximized and a simpler design facilitates the production process.

The hollow profile is preferably implemented as a rigid hollow profile. Various materials such as metals, polymers, fiber-reinforced polymers, or wood can be considered. Metals are characterized by high leak resistance for gas and vapor but have high thermal conductivity. This results in the formation of a thermal bridge in the region of the edge seal, which, in the case of large temperature differences between a cooled interior and the ambient temperature, can lead to the accumulation of condensation on the glass pane facing the external surroundings. This, in turn, results in obstruction of the view of goods presented in a refrigerated display case. This problem can be avoided by the use of materials with low thermal conductivity. Such spacers are referred to as a so-called "warm edge" spacers. However, these materials with low thermal conductivity often have inferior properties in terms of leak resistance for gas and vapor.

In a preferred embodiment, a gas- and vapor-tight barrier is attached on the outer wall and a part of the side walls. The gas- and vapor-tight barrier improves the leak resistance of the spacer against gas loss and moisture penetration. In a preferred embodiment, the barrier is implemented as a film. This barrier film includes at least one polymeric layer as well as a metallic layer or a ceramic layer. The layer thickness of the polymeric layer is between 5 μm and 80 μm, while metallic layers and/or ceramic layers with a thickness of 10 nm to 200 nm are used. Within the range of layer thicknesses mentioned, particularly good leak resistance of the barrier film is obtained.

Particularly preferably, the barrier film includes at least two metallic layers and/or ceramic layers that are arranged alternatingly with at least one polymeric layer. Preferably, the outward lying layers are formed by the polymeric layer. The alternating layers of the barrier film can be joined to or applied on one another in a wide variety of known prior art methods. Methods for depositing metallic or ceramic layers are well known to the person skilled in the art. The use of a barrier film with an alternating layer sequence is particularly advantageous in terms of the leak resistance of the system. A defect in one of the layers does not result in a functional loss of the barrier film. By comparison, in the case of a single layer, one small defect can already result in a complete failure. Moreover, the application of a plurality of thin layers is advantageous compared to one thick layer since the risk of internal adhesion problems increases with increasing layer thickness. Furthermore, thicker layers have higher conductivity so such a film is less suitable thermodynamically.

The polymeric layer of the film preferably includes polyethylene terephthalate, ethylene vinyl alcohol, polyvinylidene chloride, polyamides, polyethylene, polypropylene, silicones, acrylonitriles, polyacrylates, polymethyl acrylates, polymethyl methacrylates, and/or copolymers or mixtures thereof. The metallic layer preferably includes iron, aluminum, silver, copper, gold, chromium, and/or alloys or oxides thereof. The ceramic layer of the film preferably includes silicon oxides and/or silicon nitrides.

The film preferably has gas permeation less than 0.001 $g/(m^2 h)$.

In an alternative preferred embodiment, the gas- and vapor-tight barrier is implemented as a coating. This barrier coating contains aluminum, aluminum oxides, and/or silicon oxides and is preferably applied using a PVD method (physical vapor deposition). The coating containing aluminum, aluminum oxides, and/or silicon oxides delivers particularly good results in terms of leak resistance and also presents excellent adhesion properties with the secondary sealant used in the insulating glass element.

Preferably, the hollow profile is made of polymers, since they have low thermal conductivity, resulting in improved thermal insulation properties of the edge seal. Particularly preferably, the hollow profile includes biocomposites, polyethylene (PE), polycarbonates (PC), polypropylene (PP), polystyrene, polybutadiene, polynitriles, polyesters, polyurethanes, polymethyl methacrylates, polyacrylates, polyamides, polyethylene terephthalate (PET), polybutylene terephthalate (PBT), polyvinyl chloride (PVC), particularly preferably acrylonitrile butadiene styrene (ABS), acrylonitrile styrene acrylester (ASA), acrylonitrile butadiene styrene/polycarbonate (ABS/PC), styrene acrylonitrile (SAN), PET/PC, PBT/PC, and/or copolymers or mixtures thereof.

Preferably, the hollow profile contains polymers and is glass-fiber-reinforced. The hollow profile preferably has a glass fiber content of 20% to 50%, particularly preferably of 30% to 40%. The glass fiber content in the polymeric hollow profile improves strength and stability. Through the selection of the glass fiber content in the hollow profile, the coefficient of thermal expansion of the hollow profile can be varied and adjusted. Through adjustment of the coefficient of thermal expansion of the hollow profile and of the barrier film or barrier coating, temperature-induced stresses between the different materials and flaking of the barrier film or of the barrier coating can be avoided.

The hollow profile preferably has, along the glazing interior wall, a width of 5 mm to 45 mm, preferably of 10 mm to 24 mm. In the context of the invention, the width is the dimension extending between the side walls. The width is the distance between the surfaces of the two side walls facing away from one another. The distance between the panes of the insulating glass element is determined by the selection of the width of the glazing interior wall. The exact measure of the glazing interior wall is governed by the dimensions of the insulating glass element and the desired size of the interpane space.

The hollow profile preferably has, along the side walls, a height of 5 mm to 15 mm, particularly preferably of 5 mm to 10 mm. In this range for the height, the spacer has advantageous stability, but is, on the other hand, advantageously inconspicuous in the insulating glass element. Also, the hollow space of the spacer has an advantageous size for accommodating a suitable amount of desiccant. The height is the distance between the surfaces of the outer wall and the glazing interior wall facing away from one another.

The wall thickness d of the hollow profile is 0.5 mm to 15 mm, preferably 0.5 mm to 10 mm, particularly preferably 0.7 mm to 1.2 mm.

In a preferred embodiment, the glazing interior wall has at least one opening. Preferably, a plurality of openings are made in the glazing interior wall. The total number of openings depends on the size of the insulating glass element. The openings connect the hollow space to the inner interpane space, making a gas exchange between them possible. Thus, absorption of humidity by a desiccant situated in the hollow space is allowed and, thus, fogging of the panes is prevented. The openings are preferably implemented as slits, particularly preferably as slits with a width of 0.2 mm and a length of 2 mm. The slits ensure optimum air exchange without the desiccant being able to penetrate out of hollow space into the inner interpane space.

The first pane and the second pane of the insulating glass element preferably contain glass and/or polymers, particularly preferably quartz glass, borosilicate glass, soda lime glass, polymethyl methacrylate, and/or mixtures thereof.

The first pane and the second pane have a thickness of 2 mm to 50 mm, preferably 3 mm to 16 mm, with the two panes also possibly having different thicknesses.

The insulating glass element is preferably filled with an inert gas, particularly preferably with a noble gas, preferably, argon or krypton, which reduce the heat transfer value in the inner interpane space.

In another preferred embodiment, the insulating glass element includes more than two panes. In that case, the hollow-profile spacers can, for example, include grooves in which at least one additional pane is arranged. Multiple panes can also be implemented as a composite glass pane.

The invention further relates to a door for a refrigeration cabinet at least comprising an insulating glass element according to the invention and two horizontal frame elements. The horizontal frame elements are arranged such that they obscure the view of the spacers. The horizontal frame elements are, accordingly, not transparent, in other words they block the view of the edge seal with spacers and sealant. Thus, they improve the visual appearance of the door. The horizontal frame elements surround at least the horizontal edges of the first pane and the second pane. Thus, the horizontal frame elements stabilize the door and also offer the capability of mounting additional securing means, for example, for the suspension of the panes.

For opening the door of the refrigeration cabinet, a door handle is preferably arranged on the first pane. The first pane is the pane, which, after installation of the door in the refrigeration cabinet, faces the external surroundings, i.e., faces in the direction of a customer. Because of the use of the flat profiles along the vertical edges of the insulating glass element, the stability is high enough that with the use of a door handle on the surface of the first pane, the insulating glass element is durably stable. The door handle is preferably glued. Visually, this is particularly advantageous.

Preferably, the frame elements also surround part of the vertical edges of the first pane and the second pane as well as the vertical flat profiles. This results in additional stabilization of the insulating glass element and reliably prevents premature detachment of the flat profiles in the corner region in which the vertical edges of the panes are adjacent the horizontal edges.

In another preferred embodiment of the insulating glass element according to the invention, an additional vertical frame element is installed, mounted on one of the two flat profiles and surrounding the edges of the first pane and the second pane at least in subregions. Thus, optimum stabilization of the door is obtained and additional elements such as for suspending the door can be secured on the vertical frame element. In the refrigeration cabinet, the vertical frame element is mounted on the side of the insulating glass element opposite the door opening. The at least one transparent frame element is not concealed by the vertical frame element. In the finished refrigeration cabinet, the transparent frame element faces the door opening.

The frame element preferably includes a metal sheet, particularly preferably an aluminum or stainless steel sheet. These materials enable good stabilization of the door and are compatible with the materials typically used in the region of the edge seal.

In an alternative preferred embodiment, the frame element includes polymers. Polymeric frame elements have advantageously low weight.

The invention further includes a method for producing an insulating glass element according to the invention for a refrigerated display case comprising the steps:

Providing a first pane and a second pane,

Providing two spacers and two flat profiles, wherein at least one of the flat profiles is transparent, Mounting the two spacers between the first pane and the second pane along the respective opposite edges of the panes via a primary sealant, Mounting the two flat profiles on the vertical edges of the two panes via an adhesive such that the flat profiles and the spacers define an inner interpane space between the first pane and the second pane.

Preferably, the method is carried out in the order indicated above. Through the mounting of the two spacers, first, a stable connection is established between the two panes and the distance between the panes is defined. Then, the flat profiles can be secured on the already aligned edges. Following the securing of the flat profiles, a secondary sealant is preferably applied along the spacers in the outer interpane space. This serves for mechanical stabilization of the insulating glass element.

The invention further includes another method for producing an insulating glass element according to the invention for a refrigerated display case comprising the steps:

Providing a first pane and a second pane,

Providing two spacers and two flat profiles, wherein at least one of the flat profiles is transparent, Mounting the two spacers between the first pane and the second pane along the respective opposite edges of the pane via a primary sealant, Placing the two flat profiles on the vertical edges of the first pane and on the vertical edges of the second pane such that the flat profiles and the spacers delimit an inner interpane space, Securing the flat profiles on the vertical edges of the first and second pane by applying pressure to the flat profiles with simultaneous heating.

This method is, in particular, suitable for insulating glass elements with a polymer-containing layer on the inner side of the flat profile. Such flat profiles can be bonded to the edges by local heating of the contact point between the flat profile and the glass edge. Preferably, the flat profile is heated to a temperature that is above the melting temperature of the polymer-containing layer. By means of the melting of this layer, attachment is enabled even without adhesive. This simplifies the method by eliminating a separate production step for application of an adhesive. This method is particularly preferred for insulating glass elements with a sealing layer on the inner side. Sealing layers are particularly suitable for attachment by heating while applying pressure.

Preferably, this method is also carried out in the order indicated above. Through the mounting of the two spacers, first, a stable connection is established between the two panes and the distance between the panes is defined. Then, the flat profiles can be secured on the already aligned edges. Following the securing of the flat profiles, a secondary sealant is preferably applied along the spacers in the outer interpane space. This serves for mechanical stabilization of the insulating glass element.

The invention further includes the use of the insulating glass element according to the invention as a door in a refrigerated display case or in a freezer cabinet.

Figure 2:
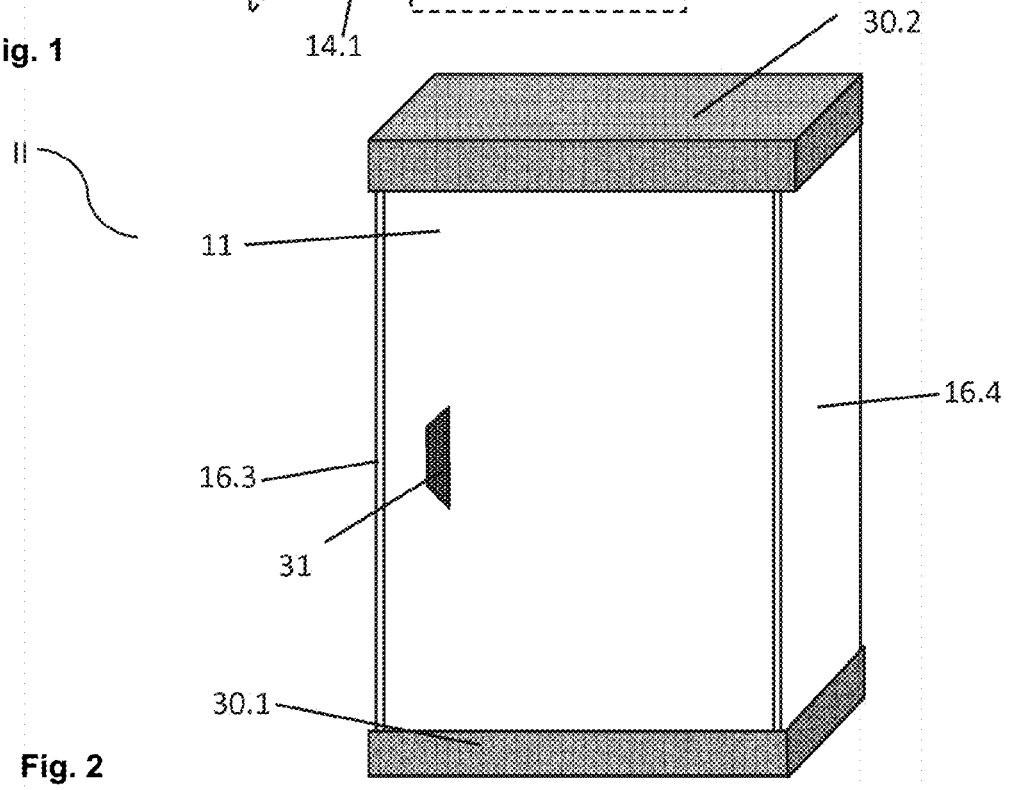
Figure 3:
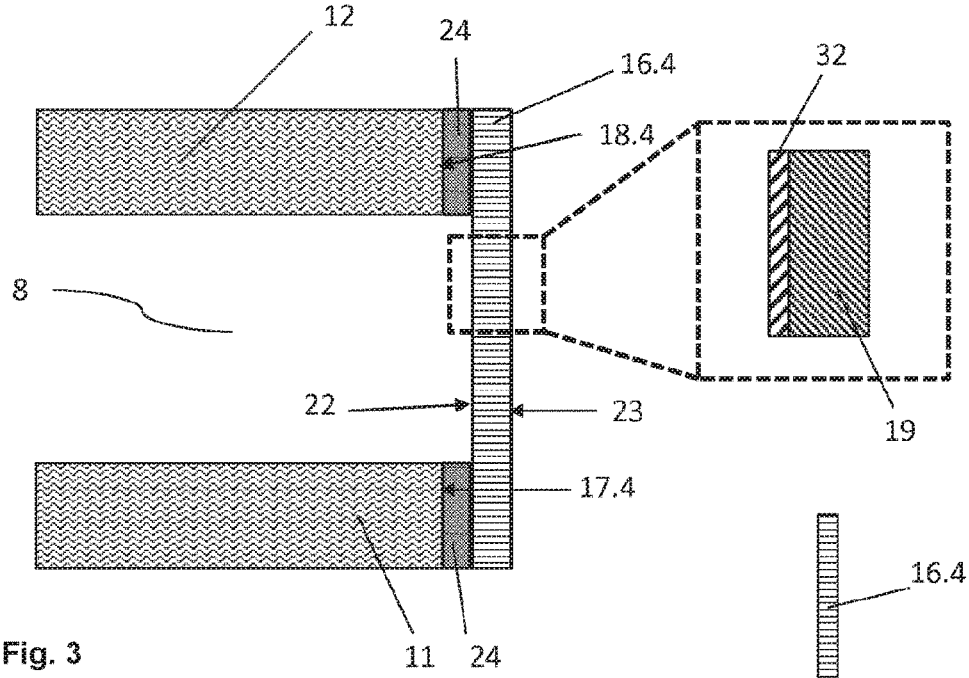
Figure 4:
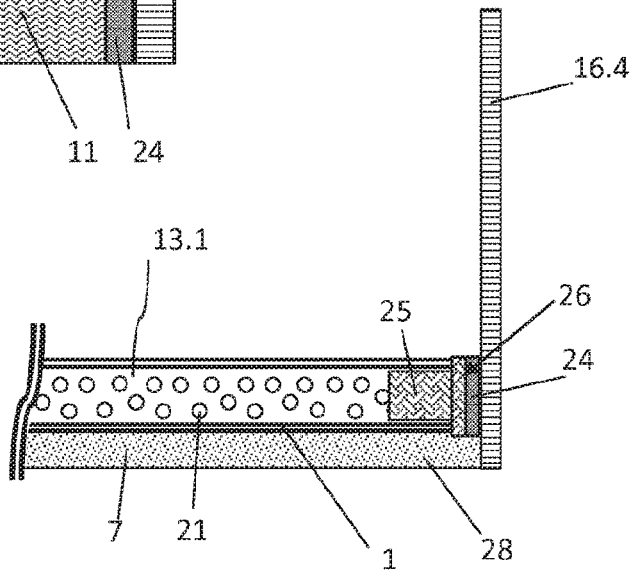
Figure 5:
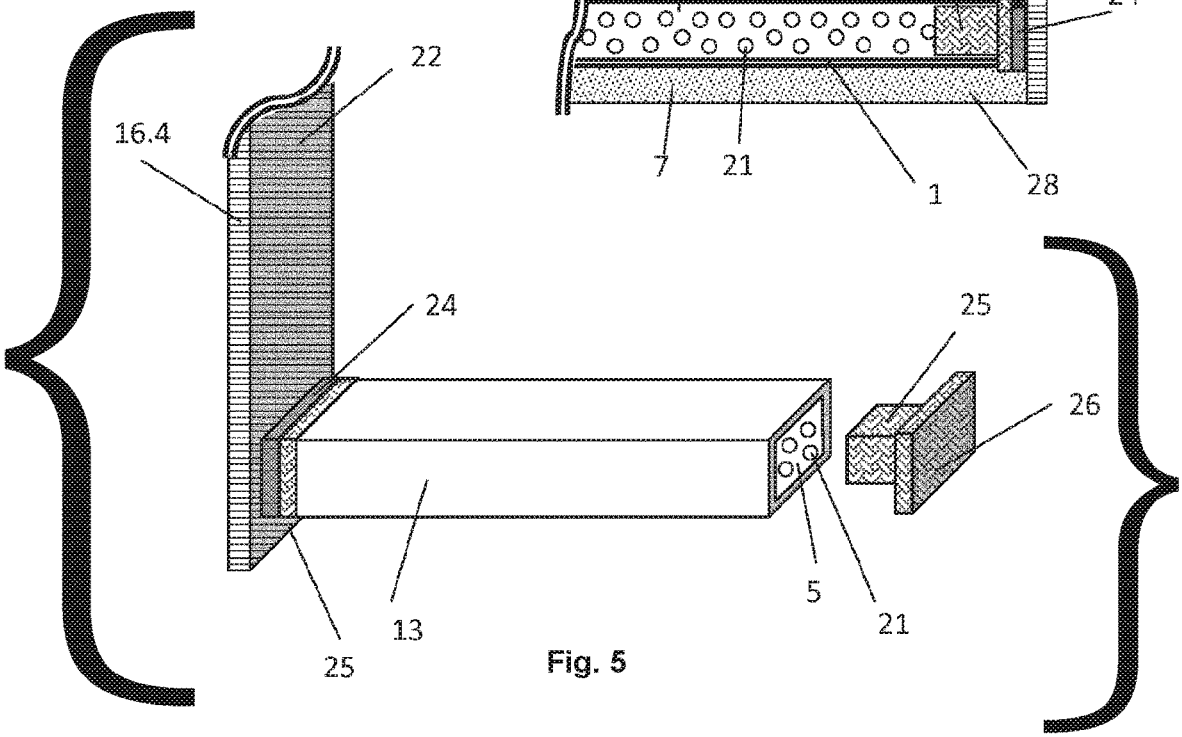
Figure 6:
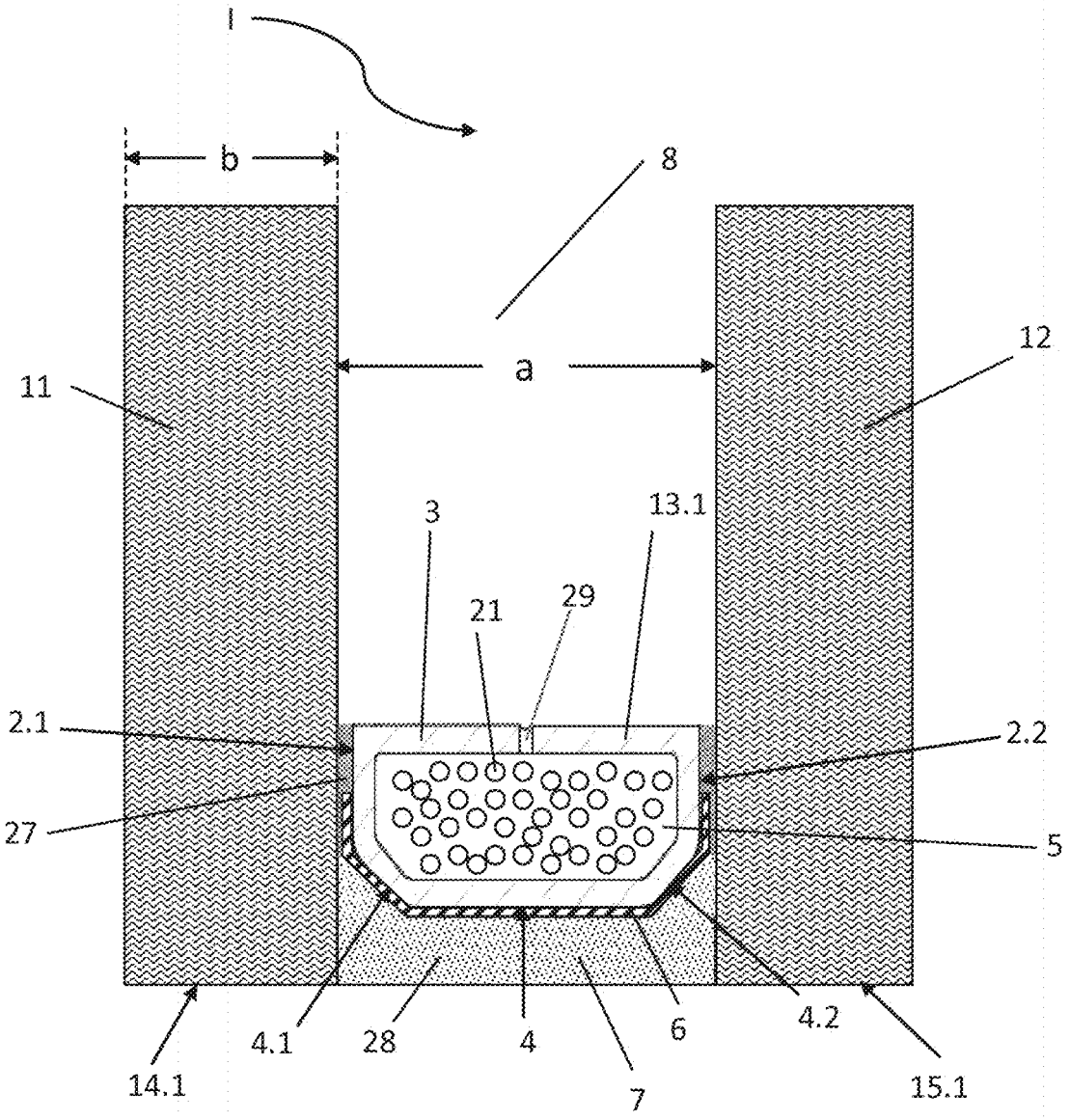
Figure 7:
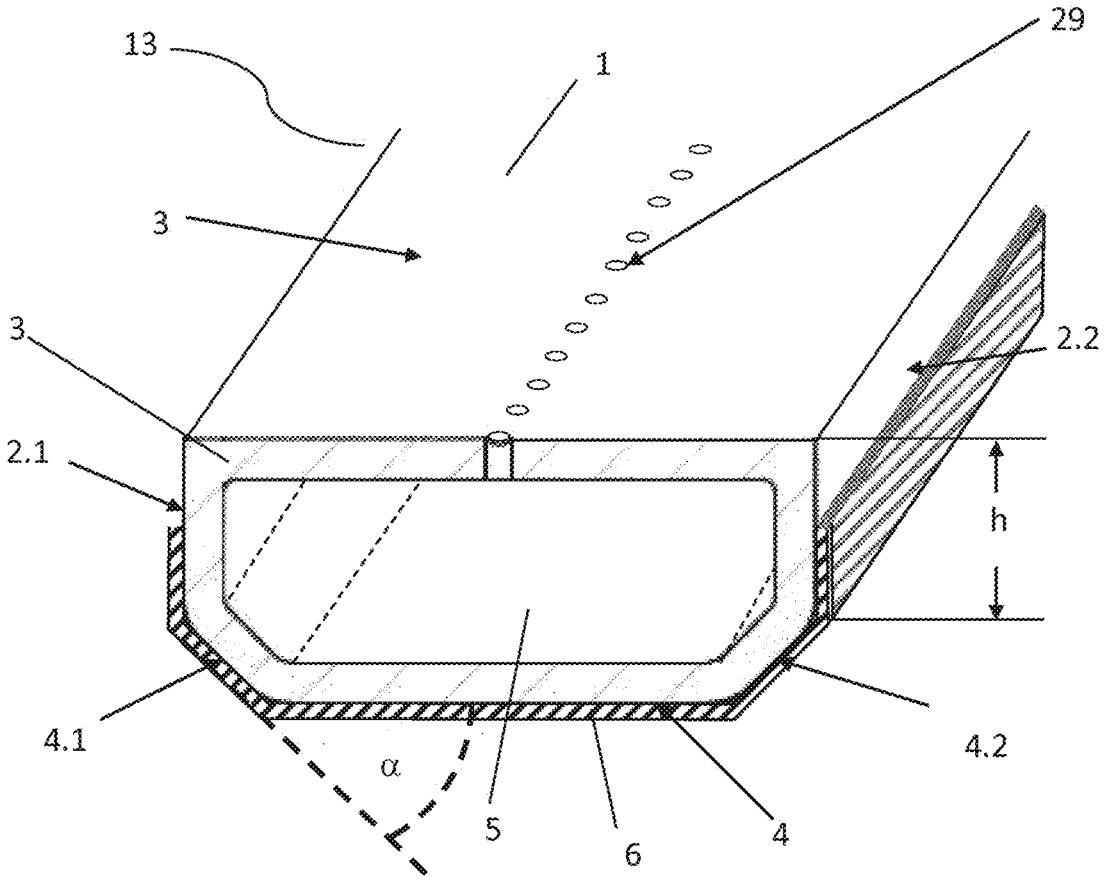
Figure 8:
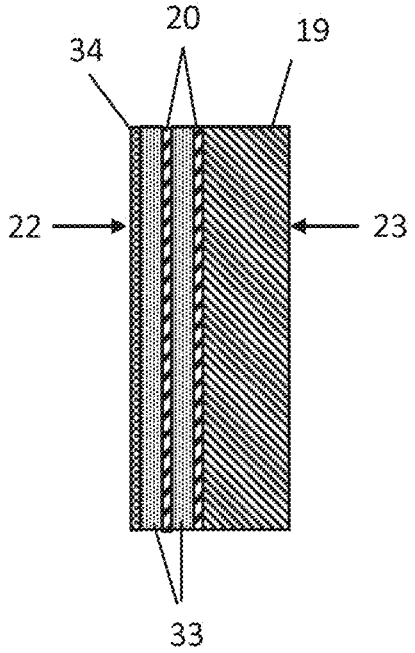

The invention is explained in detail in the following with reference to drawings. The drawings are purely schematic representations and are not true to scale. They in no way restrict the invention. They depict:

FIG. 1 a plan view of a possible embodiment of an insulating glass element according to the invention, FIG. 2 a plan view of a possible embodiment of a door according to the invention for a refrigeration cabinet, FIG. 3 a cross-section of an insulating glass element according to the invention along the sectional plane A of FIG. 1, FIG. 4 a cross-section of an insulating glass element according to the invention along the sectional plane B of FIG. 1, FIG. 5 a view of a spacer with a stopper and a flat profile intended for an insulating glass element according to the invention, FIG. 6 a cross-section of a possible embodiment of an insulating glass element according to the invention along the sectional plane C of FIG. 1, FIG. 7 a cross-section of a spacer suitable for an insulating glass element according to the invention, FIG. 8 a cross-section of a flat profile suitable for an insulating glass element according to the invention.

FIG. 1 depicts a plan view of a possible embodiment of an insulating glass element according to the invention. The insulating glass element I has a first pane 11 and a second pane 12 arranged parallel and congruently. The first pane 11 has two opposite horizontal edges 14.1 and 14.2 and two opposite vertical edges 17.3 and 17.4. The second pane 12 also has two opposite parallel horizontal edges 15.1 (hidden in the drawing) and 15.2 and two opposite vertical edges 18.3 and 18.4. An edge seal with spacer 13, primary sealant 27, and secondary sealant 28 is arranged between the panes 11 and 12 along the horizontal edges 15.2 and 14.2. Of the edge seal, only the secondary sealant 28 is shown in the drawing. A transparent flat profile 16.3 is secured on one vertical edge of the first pane 17.3 and on one vertical edge of the second pane 18.3. The transparent flat profile 16.3 stabilizes the insulating glass element I and seals the inner interpane space against the penetration of foreign objects and moisture. At the same time, it enables free through-vision even in the edge region of the insulating glass element I along the side of the insulating glass element I closed by the transparent flat profile 16.3. The transparent flat profile 16.3 includes a polymeric base film 19 substantially containing polyethylene terephthalate (PET) with a thickness of 0.4 mm and a metallic additional layer 32 made of indium tin oxide (ITO) with a thickness of 50 nm. Another transparent flat profile 16.4 is arranged on the side of the insulating glass element I opposite the transparent flat profile 16.3. The second flat profile 16.4 is secured on the vertical edges 17.4 and 18.4 of the first and second pane. Due to the likewise transparent design of the flat profile 16.4, the insulating glass element I has a maximal through-vision area. Only along the horizontal edges of the panes does an edge seal with a spacer 13 block, in each case, the view through the edge region of the insulating glass element. At the same time, the insulating glass element I is surprisingly highly stable due to the built-in flat profiles 16.4 and 16.3.

FIG. 2 depicts a door II according to the invention for a refrigerated display case. The door II comprises two horizontal frame elements 30.1 and 30.2 and an insulating glass element I as depicted in FIG. 1. The two horizontal frame elements 30.1 and 30.2 obscure the view of the horizontal spacer 13.1 and 13.2 and the edge seal with primary and secondary sealants. The horizontal frame elements 30.1 and 30.2 are formed from a 0.3-mm-thick stainless steel sheet. The frame elements 30.1 and 30.2 increase the stability of the door II. The horizontal frame element 30.2, is at the top, with perpendicular installation of the door II in a refrigerated display case, or at the rear, with horizontal installation in a freezer cabinet. The horizontal stainless steel sheet 30.2 surrounds the horizontal edges of the first and second panes 14.2 and 15.2. In addition, it surrounds part of all vertical edges of the first and second panes 17.3, 17.4, 18.3, and 18.4. The frame element 30.2 also surrounds part of the two vertical flat profiles 16.3 and 16.4, resulting in a further improvement of the stability of the door II, since the corners are protected against mechanical stress, which could under certain circumstances result in partial detachment of one of the flat profiles 16.3 or 16.4. The horizontal frame element 30.1, which would be arranged at the bottom after installation in a refrigerated display case or in the front after installation in a freezer cabinet, is structured the same as the upper or rear frame element 30.2. The horizontal frame elements 30.1 and 30.2 are glued to the insulating glass element I. Attachment means, for instance in the case of installation in a refrigerated display case or rails with use as a sliding door in a freezer cabinet can be mounted on the horizontal frame elements 30.1 and 30.2. A door handle 31 that is glued onto the first pane 11 enables simple opening and closing of the door. Thanks to the use of the two flat profiles 16.3 and 16.4, the insulating glass element I is so stable that the forces acting on the insulating glass element during opening of the door II do not adversely affect the insulating glass element.

FIG. 3 depicts a cross-section through an insulating glass element I according to the invention along the sectional plane A, looking at the sectional plane A, as indicated by an arrow in FIG. 1. The flat profile 16.4 has an inner side 22 and an outer side 23. The inner side 22 faces the inner interpane space 8 and the outer side 23 faces the external surroundings. The flat profile 16.4 is secured with the inner side 22 via a transparent acrylate adhesive 24 to the vertical edges 17.4 and 18.4 of the first and second panes 11 and 12. The flat profile 16.4 is transparent and substantially consists of a PET layer as a polymeric base film 19 and a ceramic additional layer 20 made of silicon oxides. The ceramic additional layer 20 is arranged on the inner side 22. Thus, the ceramic additional layer 20, which serves to improve the leak resistance of the flat profile, is optimally protected against damage during installation or during use.

FIG. 4 depicts a cross-section through an insulating glass element I according to the invention along the sectional plane B depicted in FIG. 1. The sectional plane B runs through the spacer 13.1. A hollow profile 1 with a hollow space 5 that is filled with desiccant 21 is visible. A suitable hollow profile 1 is described under FIG. 7. The flat profile 16.4 is secured to the vertical edges 17.4 and 16.4, which is depicted in FIG. 3. The spacer 13.1 is closed on one end with a stopper 25. The contact surface 26 of the stopper is connected to the flat profile 16.4 via a transparent acrylate adhesive 24. The stopper 25 prevents the trickling out of desiccant 21 and enables stabile gluing of the flat profile 16.4. A silicone is arranged as a secondary sealant 28 in the outer interpane space 7 on the outer surface of the spacer 13.1.

FIG. 5 depicts a spacer 13 with flat profile 16 suitable for installation in an insulating glass element I according to the invention. In this example, the spacer 13 has a rectangular cross-section. Alternatively, the spacer 13 can have a different cross-section, for example, as depicted in FIG. 7. The hollow space 5 of the spacer 13 is filled with a molecular sieve as a desiccant 21. The two ends of the spacer 13 are closed with a stopper 25. The stopper 25 is, for example, produced from a polyamide. The stopper 25 includes a portion that is inserted into the hollow space 5 of the spacer 13 and a contact surface 26 that faces the flat profile 16 in the insulating glass element I. The contact surface 26 is provided for the attachment of the flat profile 16. The contact surface 26 coordinates with the cross-section of the hollow profile 1, in other words, the contact surface of the stopper ends flush with the outer dimensions of the hollow profile. Thus, material costs for the stopper are saved.

FIG. 6 depicts a cross-section of an insulating glass element according to the invention along the sectional plane C of FIG. 1 with the viewing direction from the side toward the sectional plane C, identified by an arrow in FIG. 1. The first pane 11 is connected to the first side wall 2.1 of the spacer 13.1 via a primary sealant 27, and the second pane 12 is mounted on the second side wall 2.2 via the primary sealant 27. The primary sealant 27 contains a cross-linking polyisobutylene. The inner interpane space 8 is situated between the first pane 11 and the second pane 12 and is delimited by the glazing interior wall 3 of the spacer 13.1. The hollow space 5 is filled with a desiccant 21, for example, molecular sieve. The hollow space 5 is connected to the inner interpane space 8 via openings 29 in the glazing interior wall. A gas exchange between the hollow space 5 and the inner interpane space 8 occurs through the openings 29, with the desiccant 21 absorbing the humidity from the inner interpane space 8. The first pane 11 and the second pane 12 protrude beyond the side walls 2.1 and 2.2 such that an outer interpane space 7 is created, situated between the first pane 11 and the second pane 12 and delimited by the outer wall of the spacer 4. The horizontal edge 14.1 of the first pane 11 and the horizontal edge 15.1 of the second pane 12 are arranged at the same level. The outer interpane space 7 is filled with the secondary sealant 28. The secondary sealant 28 is, for example, a silicone. Silicones absorb the forces acting on the edge seal particularly well and thus contribute to high stability of the insulating glass element I. The first pane 11 and the second pane 12 are made of soda lime glass with a thickness of 3 mm.

FIG. 7 depicts a cross-section of a spacer 13 suitable for an insulating glass element I according to the invention. The hollow profile 1 comprises a first side wall 2.1, a side wall 2.2 parallel thereto, a glazing interior wall 3, and an outer wall 4. The glazing interior wall 3 runs perpendicular to the side walls 2.1 and 2.2 and connects the two side walls. The outer wall 4 is opposite the glazing interior wall 3 and connects the two side walls 2.1 and 2.2. The outer wall 4 runs substantially perpendicular to the side walls 2.1 and 2.2. The sections of the outer wall 4.1 and 4.2 nearest the sidewalls 2.1 and 2.2 are, however, inclined at an angle of approx. 45° relative to the outer wall 4 in the direction of the sidewalls 2.1 and 2.2. The angled geometry improves the stability of the hollow profile 1 and enables better bonding with the barrier film 6. The wall thickness d of the hollow profile is 1 mm. The hollow profile 1 has, for example, a height h 6.5 mm and a width of 15 mm. The outer wall 4, the glazing interior wall 3, and the two side walls 2.1 and 2.2 enclose the hollow space 5. The hollow space 5 can, for example, accommodate a desiccant 21. The hollow profile 1 is a polymeric glass-fiber-reinforced hollow profile, which contains styrene acrylonitrile (SAN) with a glass fiber content of approx. 35 wt.-%. The polymeric glass-fiber-reinforced hollow profile 1 is characterized by particularly low thermal conductivity and, at the same time, high stability. A gas- and vapor-tight barrier film 6, which improves the leak resistance of the spacer 13, is applied on the outer wall 4 and approx. one half of the side walls 2.1 and 2.2. The barrier film 6 can, for example, be secured on the hollow profile 1 with a polyurethane hotmelt adhesive. The barrier film 6 comprises four polymeric layers made of polyethylene terephthalate with a thickness of 12 μm and three metallic layers made of aluminum with a thickness of 50 nm. The metallic layers and the polymeric layers are applied alternatingly in each case, with the two outer plies formed by polymeric layers.

FIG. 8 depicts a cross-section of a transparent flat profile suitable for an insulating glass element I according to the invention. The transparent flat profile 16.3 includes a polymeric base film 19 made of PET with a thickness of 0.5 mm. The polymeric base film 19 is connected to a multilayer structure of ceramic additional layers 20 and polymeric additional layers 33 as well as a sealing layer 34. Included as ceramic additional layers 20 are two 50-nm-thick silicon oxide ($SiO_x$) layers. The silicon oxide layers 20 are arranged alternatingly with two polymeric additional layers 33 made of 12-μm-thick PET. The production of the flat profile can be done, for example, by bonding two 12-μm-thick PET films 33 coated with two silicon oxide layers 20 with a polyurethane adhesive. The silicon oxide layer arranged next to the polymeric base film 19 improves the adhesion to the PET of the polymeric base film 19, which is bonded via a laminating adhesive. A sealing layer 34 made of a heat sealable LDPE is applied on the inner side 22 of the flat profile 16.3. Subsequently, a simple attachment of the transparent flat profile 16.3 to the vertical edges (17.3, 17.4, 18.3, 18.4) of the panes of the insulating glass element I is done via the sealable LDPE by heating.

LIST OF REFERENCE CHARACTERS

I insulating glass element
II door for a refrigeration cabinet
1 hollow profile
2 side walls
2.1 first side wall
2.2 second side wall
3 glazing interior wall
4 outer wall
4.1, 4.2 the sections of the outer wall nearest the side walls
5 hollow space
6 barrier film
7 outer interpane space
8 inner interpane space
11 first pane
12 second pane
13 spacers
13.1, 13.2 spacers along the horizontal sides of the insulating glass element I
14.1, 14.2 horizontal edges of the first pane
15.1, 15.2 horizontal edges of the second pane
16.3, 16.4 transparent flat profile
17.3, 17.4 vertical edges of the first pane
18.3, 18.4 vertical edges of the second pane
19 polymeric base film of the transparent flat profile
20 ceramic additional layer of the transparent flat profile
21 desiccant
22 inner side of the flat profile
23 outer side of the flat profile
24 transparent adhesive
25 stopper
26 contact surface of the stopper
27 primary sealant
28 secondary sealant
29 openings in the glazing interior wall
30.1, 30.2 horizontal frame elements
31 door handle
32 metallic additional layer
33 polymeric additional layer
34 sealing layer
a distance between the first and the second pane
b edge width of a pane/thickness of a pane
c length of a flat profile

The invention claimed is:

1. An insulating glass element for a refrigeration cabinet, comprising:

(a) a first pane having a first horizontal edge, a second horizontal edge opposite and parallel to the first horizontal edge, a first vertical edge and a second vertical edge opposite and parallel to the first vertical edge;

(b) a second pane having a first horizontal edge, a second horizontal edge opposite and parallel to the first horizontal edge, a first vertical edge and a second vertical edge opposite and parallel to the first vertical edge;

(c) two horizontally arranged spacers between the first pane and the second pane;

(d) a first vertically arranged flat profile secured to the first vertical edge of the first pane and the first vertical edge of the second pane;

(e) a second vertically arranged flat profile secured to the second vertical edge of the first pane and the second vertical edge of the second pane, wherein the two spacers and the first and second flat profiles enclose an inner interpane space between the first pane and the second pane, and one of the first or second vertically arranged flat profiles is transparent.

2. The insulating glass element according to claim 1, wherein one of the first or second vertically arranged transparent flat profiles includes one polymeric base film and one ceramic additional layer.

3. The insulating glass element according to claim 2, wherein one of the first or second vertically arranged transparent flat profiles includes one polymeric additional layer and two ceramic additional layers and/or metallic additional layers, wherein the two ceramic additional layers and/or metallic additional layers are arranged alternatingly with the one polymeric additional layer.

4. The insulating glass element according to claim 2, wherein the first and second vertically arranged flat profiles have a sealing layer facing their inner side.

5. The insulating glass element according to claim 2, wherein the polymeric base film includes one or more of polyethylene (PE), polycarbonates (PC), polyesters, polyurethanes, polymethyl methacrylates, polyacrylates, polyamides, polyethylene terephthalate (PET), ethylene vinyl alcohol (EVOH), PET/PC, and copolymers thereof.

6. The insulating glass element according to claim 2, wherein the polymeric base film has a thickness of 0.2 mm to 5 mm.

7. The insulating glass element according to claim 1, wherein one of the first or second vertically arranged transparent flat profiles includes one polymeric base film and one transparent metallic additional layer.

8. The insulating glass element according to claim 1, wherein the first vertically arranged flat profile has an inner side and an outer side, wherein the first vertically arranged flat profile is secured with its inner side to the first vertical edge of the first pane and the first vertical edge of the second pane via a transparent adhesive, the second vertically arranged flat profile has an inner side and an outer side, and the second vertically arranged flat profile is secured with its inner side to the second vertical edge of the first pane and the second vertical edge of the second pane via a transparent adhesive.

9. The insulating glass element according to claim 1, wherein the two horizontally arranged spacers are secured via a primary sealant to the first pane and the second pane, and wherein an outer interpane space facing the external external surroundings is filled with a secondary sealant.

10. The insulating glass element according to claim 1, wherein one of the two horizontally arranged spacers contains a desiccant.

11. The insulating glass element according to claim 1, wherein each of the two horizontally arranged spacers comprises a hollow profile, the hollow profile comprising:

(a) a first side wall;

(b) a second side wall arranged parallel to the first side wall;

(c) a glazing interior wall arranged perpendicular to the first and second side walls, the glazing interior wall connecting the first and second side walls to each other;

(d) an outer wall arranged parallel to the glazing interior wall and connecting the first and second side walls to each other;

(e) a hollow space, surrounded by the first and second side walls, the glazing interior wall, and the outer wall, and (f) the hollow space being filled partially with a desiccant.

12. The insulating glass element according to claim 11, wherein the two horizontally arranged individual spacers are closed at both ends with a stopper, and wherein each stopper includes a contact surface for connecting to the first or second vertically arranged flat profile.

13. A door for a refrigeration cabinet, comprising:

the insulating glass element according to claim 1; and two horizontal frame elements, wherein the two horizontal frame elements are arranged such that they obscure the view of the two horizontally arranged spacers, the two horizontal frame elements surround the first and second horizontal edges of the first pane, and first and second horizontal edges of the second pane, and a door handle is arranged on the first pane.

14. A method for producing an insulating glass element for a refrigeration cabinet, comprising:

(a) providing a first pane and a second pane, (b) mounting two spacers along two opposite sides of the insulating glass element between the first and second panes by a primary sealant, (c) placing two flat profiles on the vertical edges of the first pane and on the vertical edges of the second pane such that the two flat profiles and the two spacers delimit an inner interpane space, and (d) securing the two flat profiles by heating and simultaneous pressing in the region of the vertical edges of the first pane and the the second pane.

15. A method of using an insulating glass element, comprising:

providing the insulating glass unit according to claim 1; and using the insulating glass unit as a door in a refrigerated display case.

16. A method for producing an insulating glass element for a refrigeration cabinet, comprising:

(a) providing a first pane and a second pane, (b) mounting two spacers along two opposite sides of the insulating glass element between the first and second panes by a primary sealant, and (c) securing two flat profiles on the vertical edges of the first pane and on the vertical edges of the second pane via an adhesive, such that the two flat profiles and the two spacers delimit an inner interpane space.

17. A method of using an insulating glass element, comprising:

providing the insulating glass unit according to claim 1; and using the insulating glass unit as a door in a freezer cabinet.

* * * * *